US007596898B2

(12) United States Patent
Thollin

(10) Patent No.: US 7,596,898 B2
(45) Date of Patent: Oct. 6, 2009

(54) AFTERGLOWING SIGN

(75) Inventor: Sven Thollin, Staffanstorp (SE)

(73) Assignee: System-Text AB, Malmö (SE)

( * ) Notice: Subject to any disclaimer, the term of this patent is extended or adjusted under 35 U.S.C. 154(b) by 50 days.

(21) Appl. No.: 10/467,299

(22) PCT Filed: Feb. 20, 2002

(86) PCT No.: PCT/SE02/00290

§ 371 (c)(1),
(2), (4) Date: Aug. 7, 2003

(87) PCT Pub. No.: WO02/067230

PCT Pub. Date: Aug. 29, 2002

(65) Prior Publication Data

US 2004/0055483 A1 Mar. 25, 2004

(30) Foreign Application Priority Data

Feb. 23, 2001 (SE) ..... 0100615

(51) Int. Cl.
*G09F 13/20* (2006.01)

(52) U.S. Cl. ..... 40/542; 428/690

(58) Field of Classification Search ..... 40/542; 428/203, 204, 690; 283/93
See application file for complete search history.

(56) References Cited

U.S. PATENT DOCUMENTS

| | | | | |
|---|---|---|---|---|
| 3,591,942 | A | 7/1971 | Van Swearingen | |
| 4,151,667 | A * | 5/1979 | Idelson et al. | 283/92 |
| 4,500,116 | A * | 2/1985 | Ferro et al. | 283/92 |
| 5,414,947 | A | 5/1995 | Hjaltason | |
| 5,433,807 | A * | 7/1995 | Heckenkamp et al. | 156/230 |
| 5,698,301 | A * | 12/1997 | Yonetani | 428/213 |
| 6,048,595 | A * | 4/2000 | Nakajima et al. | 428/40.1 |
| 6,074,739 | A | 6/2000 | Katagiri | |
| 6,076,294 | A * | 6/2000 | Durbin | 40/544 |
| 6,131,322 | A | 10/2000 | Hjaltason | |
| 6,210,776 | B1 * | 4/2001 | Hill | 428/187 |
| RE37,186 | E * | 5/2001 | Hill | 428/187 |
| 6,375,864 | B1 * | 4/2002 | Phillips et al. | 252/301.33 |
| 6,395,408 | B1 * | 5/2002 | Nelson et al. | 428/690 |
| 6,505,554 | B1 * | 1/2003 | Rhein | 101/129 |
| 6,534,163 | B1 | 3/2003 | Takatsu | |
| 6,656,566 | B1 * | 12/2003 | Kuykendall et al. | 428/138 |
| 2004/0055483 | A1 * | 3/2004 | Thollin | 101/35 |
| 2007/0193090 | A1 * | 8/2007 | Thollin | 40/546 |

FOREIGN PATENT DOCUMENTS

DE 296 10 580 U1 6/1996

(Continued)

OTHER PUBLICATIONS

English Translation of Official Letter from Polish Counterpart Application No. 363441, dated May 20, 2008.

(Continued)

*Primary Examiner*—Joanne Silbermann
(74) *Attorney, Agent, or Firm*—Buchanan Ingersoll & Rooney PC

(57) ABSTRACT

The present invention relates to an afterglowing sign printed with afterglowing pigments. The sign is provided at least partially with a screen print using opaque or transparent ink.

34 Claims, 3 Drawing Sheets

FOREIGN PATENT DOCUMENTS

| | | |
|---|---|---|
| DE | 295 02 699 | 7/1996 |
| DE | 296 10 580 | 9/1996 |
| FR | 897807 | 4/1945 |
| GB | 2 034 503 | 6/1980 |
| GB | 2 109 606 | 6/1983 |
| GB | 2 147 542 | 5/1985 |
| GB | 2 332 081 | 6/1999 |
| HU | 218403 | 9/1992 |
| HU | P0200108 | 1/2002 |
| JP | 5-031980 U | 4/1993 |
| JP | 7-287541 | 10/1995 |
| JP | 09-300517 | 5/1996 |
| JP | 09-031369 | 2/1997 |
| JP | 10-056578 A | 2/1998 |
| JP | 10-171392 | 6/1998 |
| JP | 2000-079751 | 3/2000 |
| WO | WO 93/07605 | 4/1993 |
| WO | WO 96/29692 | 9/1996 |
| WO | WO 97/12646 | 4/1997 |
| WO | WO 97/15453 A1 | 5/1997 |

OTHER PUBLICATIONS

Official Action for corresponding Canadian Application No. 2,438,045 (mailed on Aug. 1, 2008).

* cited by examiner

AFTERGLOWING SIGN

FIELD OF THE INVENTION

The present invention relates to an afterglowing sign printed with afterglowing pigments.

BACKGROUND ART

In the case of danger, alarm, fire, smoke formation, threats, etc., the presence of clearly visible signs in premises is extremely important, for example for indicating the nearest escape route or the location of fire extinguishing equipment. According to the colour requirements stipulated by the appropriate authority, the signs shall have one or more white, standardised symbols on red or green background.

Some of the existing afterglowing safety signs are used, inter alia, to indicate and display escape routes and emergency exits and to indicate the location of fire extinguishing equipment. However, the afterglowing pigments used do not exist in the colour shades needed to obtain an optimal colour reproduction both in daylight and, with a coloured afterglow, in the dark. The solution to this problem has so far been to accept that these signs show afterglowing symbols only in the dark, in which case their background colour has been perceived as black. Thus, the colour requirements for these afterglowing safety signs are met only in daylight and in lit places, since the afterglowing pigments available do not completely fulfil the requirements both in daylight/lit spaces and in the dark.

SUMMARY OF THE INVENTION

It is therefore an object of the present invention to provide an afterglowing sign which affords an optimal colour reproduction both in daylight and, with a coloured afterglow, in the dark. This object is achieved by the afterglowing sign, which is printed with afterglowing pigments, being provided at least partially with a screen printing using opaque or transparent ink.

In a preferred embodiment of the present invention, a contour recess is provided in the afterglowing ground surface along the contour of symbols printed on the sign in order to increase the contrast between the symbols and the background in the dark.

In a further preferred embodiment, the afterglowing pigments are white/yellowish-white, red and/or green.

In yet another embodiment, the screen printing is a line screen or a dot screen.

In one embodiment, the afterglowing pigments are printed as whole surfaces, in the form of screens, or incorporated into the material of the sign.

In one embodiment, the sign is made of metal, plastic or composite and, in another embodiment, it is made of a transparent or translucent material.

BRIEF DESCRIPTION OF THE DRAWINGS

The invention will be described in more detail in the following by means of one preferred embodiment and with reference to the accompanying drawings, in which.

DESCRIPTION OF A PREFERRED EMBODIMENT

Figure 1:
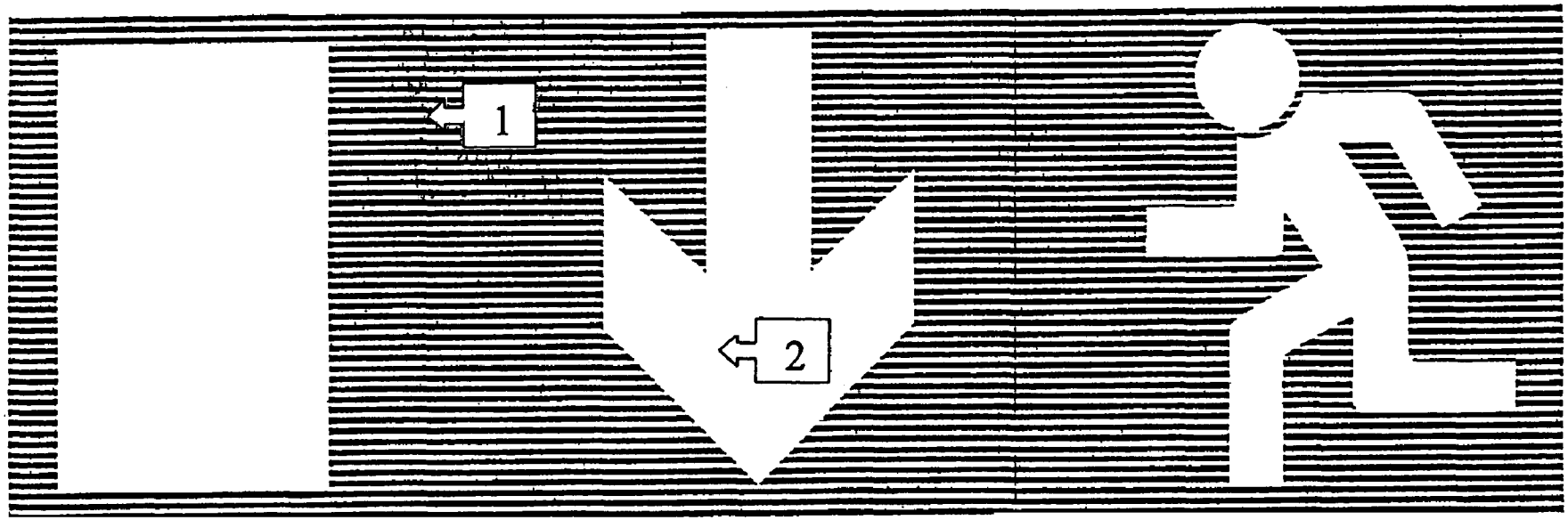
FIG. 1 is a view of a sign according to the invention, a line screen being used when adding the supplementary opaque or, alternatively, transparent ink.
Figure 2:
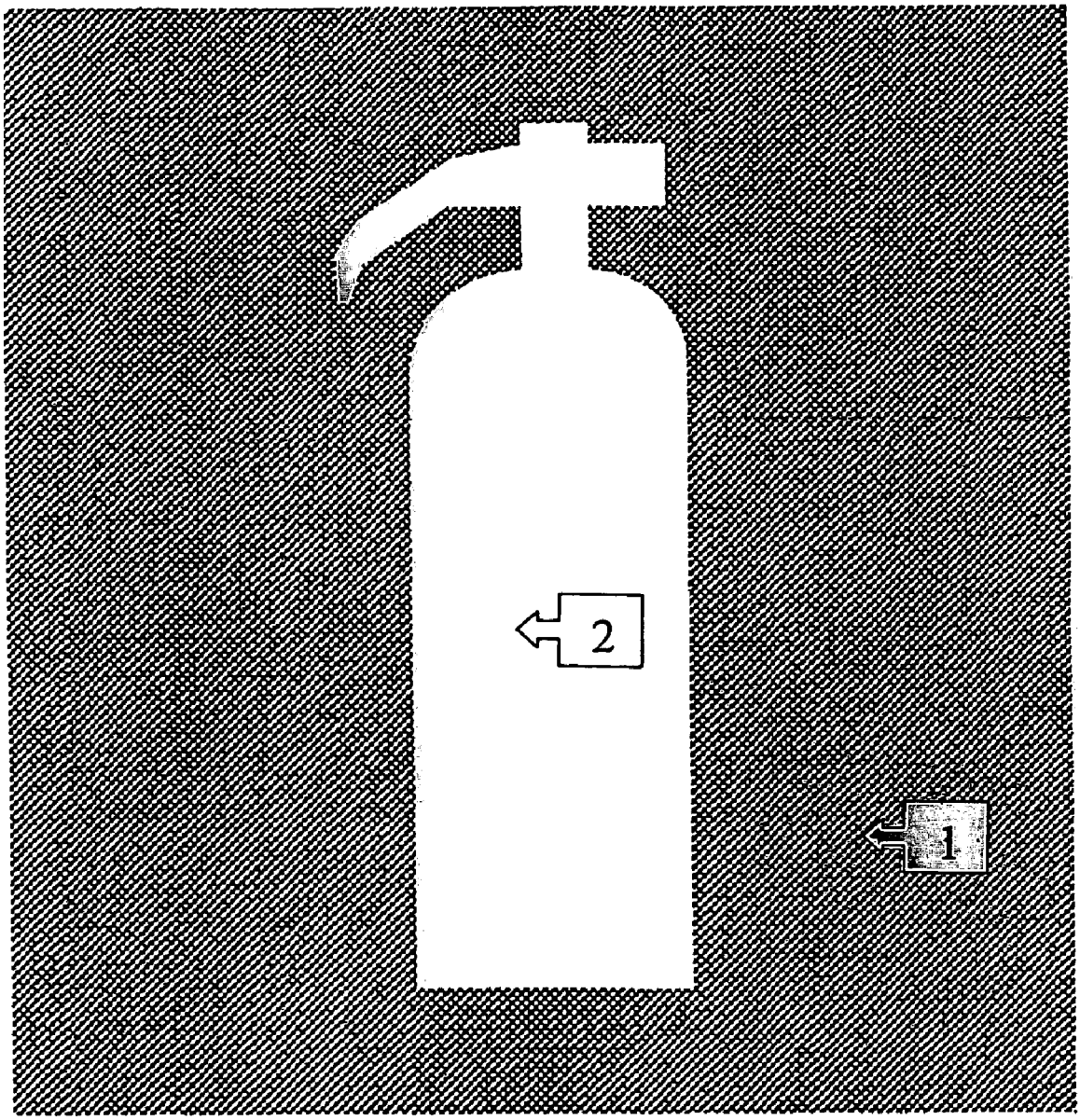
FIG. 2 is a view of a sign according to the invention, a dot screen being used when adding the supplementary opaque or, alternatively, transparent ink.

FIG. 1 and FIG. 2 illustrate two preferred signs according to the present invention. FIG. 1 shows an escape route sign, which, according to standard, has a green background 1 and white symbols 2 and border rule. FIG. 2 shows a sign for indicating the location of fire extinguishing equipment, which, according to standard, has a red background 1 and a white symbol 2 and border rule.

The signs are made of aluminium or plastic and are silk screen printed. Any type of afterglowing pigments may be used; preferred but non-limiting pigments are $Mo.Al_2O_3$ doped with Eu as white/yellowish-white afterglowing pigment, (CaO, 8 SrO, 2)S—CaS as red afterglowing pigment, and $Mo.Al_2O_3$ doped with Eu plus fluorescent green pigment as green afterglowing pigment.

The choice of afterglowing pigment or afterglowing ink is not decisive. Thus, the technical effect is not dependent on the pigment or the ink used to obtain the afterglowing print, if the sign is provided with a screen of opaque or transparent ink.

Figure 3:
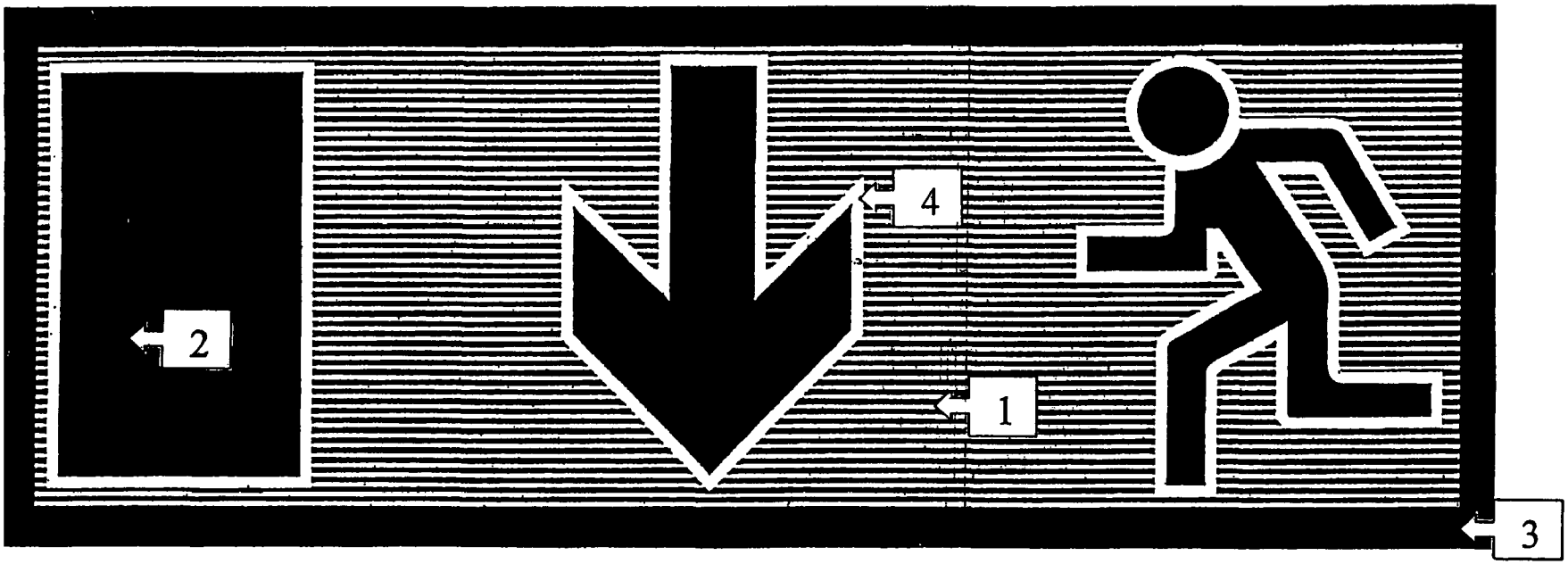
FIG. 3 is a schematic view of a sign according to the invention, in which a contour recess is formed in the afterglowing ground surface along the contour of the symbols.

First, the afterglowing pigments are printed on the sign either as whole surfaces or as a screen print. A contour recess 4 along the contour of the symbols 2 and the border rule 3, with a width of about 1.5-3 mm, may also be made (see FIG. 3) when printing the afterglowing ground surface in order to increase the contrast between the background 1 and the symbols 2/border rule 3 in the dark.

The surfaces printed with respectively red and green afterglowing pigments, i.e. the background, are supplemented by a line screen (FIG. 1) or, alternatively, a dot screen (FIG. 2) of opaque or transparent ink. Preferably, the screen is printed with respectively red and green opaque ink to supplement the red or green afterglowing background.

It will be appreciated that modifications of the preferred embodiments described above are possible within the scope of the invention, as defined by the appended claims. For example, the afterglowing sign does not have to be an escape route sign or a sign indicating the location of fire extinguishing equipment, but may be of some other type, for instance a sign used for advertising purposes.

The invention claimed is:

1. An afterglowing sign comprising:

a background surface, including at least one symbol, printed with afterglowing pigments, and a screen print using opaque or transparent ink printed on the afterglowing pigments to supplement the afterglowing background surface around the at least one symbol, wherein a contour recess is formed in an afterglowing ground surface along the contour of symbols printed on the sign.

2. An afterglowing sign according to claim 1, wherein the afterglowing pigments afterglow with a color of white/yellowish-white, red and/or green.

3. An afterglowing sign according to claim 2, wherein the screen print is of the line screen or dot screen type.

4. An afterglowing sign according to claim 1, wherein the screen print is of the line screen or dot screen type.

5. An afterglowing sign according to claim 1, wherein the afterglowing pigments are printed as whole surfaces, in the form of screens, or are incorporated into the material of the sign.

6. An afterglowing sign according to claim 1, wherein the sign is made of metal, plastic or composite.

7. An afterglowing sign according to claim 1, wherein the sign is made of a transparent or translucent material.

8. An afterglowing sign comprising:

a background surface, including at least one symbol, letter or number printed with afterglowing pigments, and a screen print using opaque or transparent ink printed on the afterglowing pigments to supplement the afterglowing background surface around the at least one symbol, letter or number, wherein a contour recess is formed in an afterglowing ground surface along the contour of symbols printed on the sign.

9. An afterglowing sign comprising a background surface, the background surface comprising:

at least one symbol and a background area, the at least one symbol comprising afterglowing pigments that afterglow with a first color, wherein the symbol has the first color in a dark environment and a second color in a lighted environment, wherein the symbol is not a screen printing, the at least one symbol being defined by a printing in the background area, the background area comprising afterglowing pigments that afterglow with a third color, the printing in the background area comprising a screen print using opaque or transparent ink printed on the afterglowing pigments in the background area, wherein the background area has the third color in a dark environment and a fourth color in a lighted environment, wherein the first and third colors are different colors, and wherein the second and fourth colors are different, the at least one symbol being visible in a lighted environment and visible in a dark environment, the second color being visible in a lighted environment, the first color being visible in a dark environment, the background area being visible in a lighted environment and visible in a dark environment, the fourth color being visible in a lighted environment, the third color being visible in a dark environment.

10. An afterglowing sign according to claim 9, wherein the afterglowing pigments afterglow with a color of white/yellowish-white, red and/or green.

11. An afterglowing sign according to claim 10, wherein the screen print is of the line screen or dot screen type.

12. An afterglowing sign according to claim 10, wherein the afterglowing pigments are printed as whole surfaces, in the form of screens, or are incorporated into the material of the sign.

13. An afterglowing sign according to claim 10, wherein the sign is made of metal, plastic or composite.

14. An afterglowing sign according to claim 10, wherein the sign is made of a transparent or translucent material.

15. An afterglowing sign according to claim 9, wherein the screen print is of the line screen or dot screen type.

16. An afterglowing sign according to claim 15, wherein the afterglowing pigments are printed as whole surfaces, in the form of screens, or are incorporated into the material of the sign.

17. An afterglowing sign according to claim 15, wherein the sign is made of metal, plastic or composite.

18. An afterglowing sign according to claim 15, wherein the sign is made of a transparent or translucent material.

19. An afterglowing sign according to claim 9, wherein the afterglowing pigments are printed as whole surfaces, in the form of screens, or are incorporated into the material of the sign.

20. An afterglowing sign according to claim 9, wherein the sign is made of metal, plastic or composite.

21. An afterglowing sign according to claim 9, wherein the sign is made of a transparent or translucent material.

22. The afterglowing sign of claim 9, wherein the first and second colors are the same color.

23. The afterglowing sign of claim 9, wherein the third and fourth colors are the same color.

24. The afterglowing sign of claim 9, wherein the afterglowing pigments for the symbol are provided by a printing.

25. The afterglowing sign of claim 9, wherein the afterglowing pigments for the background area are provided by a printing.

26. The afterglowing sign according to claim 9, wherein a contour recess is formed in the background area along the contour of the at least one symbol printed on the sign.

27. An afterglowing sign comprising a background surface, the background surface comprising:

at least one symbol and a background area, the at least one symbol comprising a printing with afterglowing pigments that afterglow with a first color, wherein the symbol printing has the first color in a dark environment and a second color in a lighted environment, the at least one symbol being defined by a printing in the background area, wherein the printing is not a screen printing, the printing in the background area comprising a printing with afterglowing pigments that afterglow with a third color and a screen print using opaque or transparent ink printed on the printing with afterglowing pigments in the background area, wherein the printing in the background area has the third color in a dark environment and a fourth color in a lighted environment, wherein the first and third colors are different colors, and wherein the second and fourth colors are different, the at least one symbol being visible in a lighted environment and visible in a dark environment, the second color being visible in a lighted environment, the first color being visible in a dark environment, the background area being visible in a lighted environment and visible in a dark environment, the fourth color being visible in a lighted environment, the third color being visible in a dark environment.

28. An afterglowing sign according to claim 27, wherein the afterglowing pigments afterglow with a color of white/yellowish-white, red and/or green.

29. An afterglowing sign according to claim 27, wherein the screen print is of the line screen or dot screen type.

30. An afterglowing sign according to claim 27, wherein the afterglowing pigments are printed as whole surfaces, in the form of screens.

31. An afterglowing sign according to claim 27, wherein the sign is made of metal, plastic or composite.

32. An afterglowing sign according to claim 27, wherein the sign is made of a transparent or translucent material.

33. The afterglowing sign of claim 27, wherein the first and second colors are the same color.

34. The afterglowing sign of claim 27, wherein the third and fourth colors are the same color.

* * * * *